US005257905A

United States Patent [19]

Wynn et al.

[11] Patent Number: 5,257,905

[45] Date of Patent: Nov. 2, 1993

[54] ROTOR COUPLING ANTI-WINDAGE APPARATUS

[75] Inventors: Robert C. Wynn; Lowell M. Swartz, both of Winter Springs, Fla.

[73] Assignee: Westinghouse Electric Corp., Pittsburgh, Pa.

[21] Appl. No.: 880,446

[22] Filed: May 8, 1992

[51] Int. Cl.[5] ..... F01D 25/00

[52] U.S. Cl. ..... 415/216.1; 415/232; 415/122.1

[58] Field of Search ..... 403/287, 300, 335, 336, 403/337, 338; 415/216.1, 232

[56] References Cited

U.S. PATENT DOCUMENTS 1,163,276 12/1915 Sparling ..... 403/336
1,554,733 9/1925 Karle ..... 403/300
4,083,639 4/1978 Terry ..... 403/336 X

FOREIGN PATENT DOCUMENTS 440816 4/1924 Fed. Rep. of Germany ..... 403/337
651188 3/1951 United Kingdom ..... 403/337

*Primary Examiner*—Edward K. Look
*Assistant Examiner*—Todd Mattingly

[57] ABSTRACT

An anti-windage device is provided for use on the couplings formed by mating flanges of rotors for turbomachines, such as steam turbines and the like. The anti-windage device is comprised of upper and lower anti-windage ring segments. The anti-windage ring segments have holes for each of the nuts that are threaded onto the bolts that join the mating flanges into a rotor coupling. The holes enclose the nuts and the anti-windage ring segments fill the circumferential spaces between adjacent nuts. The ring segments are secured to the rotor flange by causing the nuts to bear against an annular lip formed in each hole. The depth of the holes and the axial thickness of the anti-windage ring is such that the end faces of the anti-windage ring, nuts and bolts are flush, thereby forming a smooth surface that minimizes windage.

17 Claims, 3 Drawing Sheets

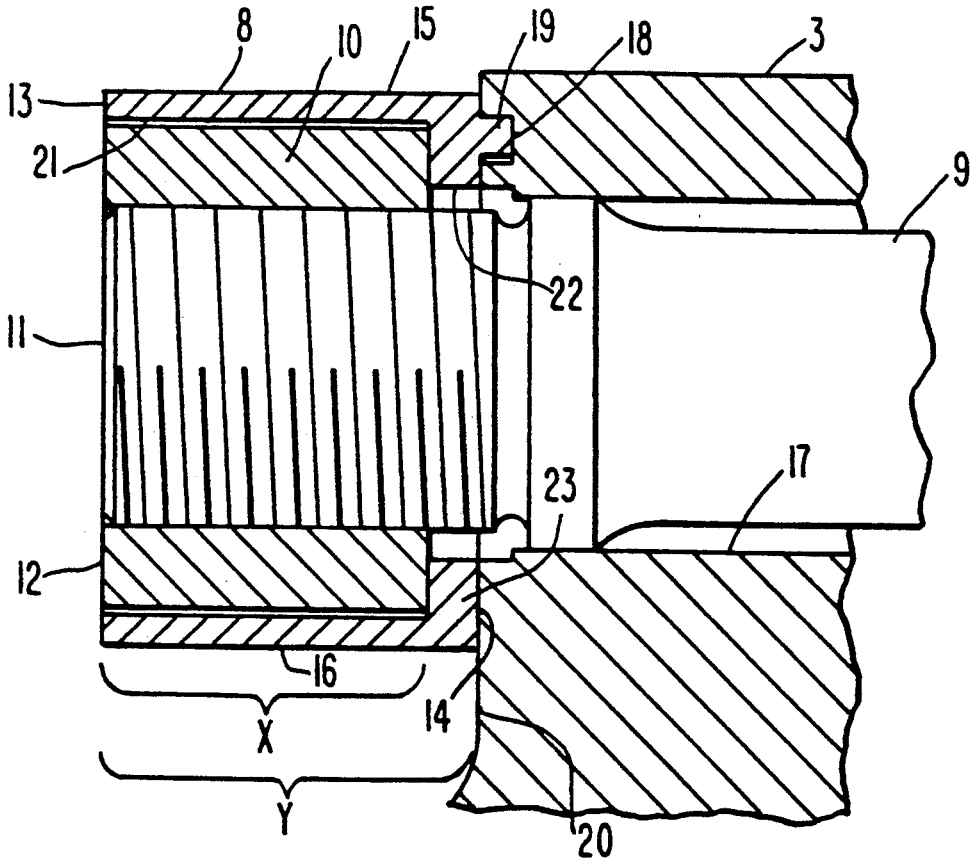
Fig. 3
Fig. 4
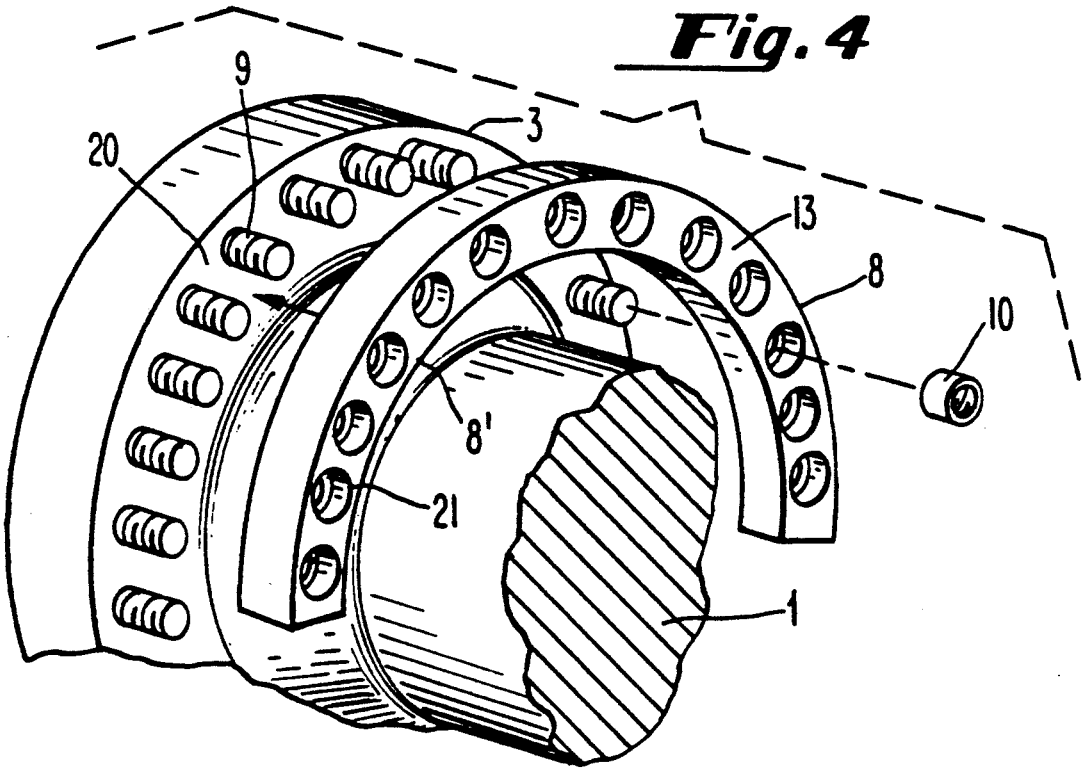

ROTOR COUPLING ANTI-WINDAGE APPARATUS

BACKGROUND OF THE INVENTION

The present invention relates to rotors for turbomachines, such as steam turbines and the like. More specifically, the present invention relates to an apparatus for reducing the power loss associated with windage in the vicinity of the rotor coupling of a turbomachine.

Turbomachines, such as steam and gas turbines and the like, employ a rotor that transmits rotational power to the corresponding rotor of a driven device, which may be an electric generator, compressor, etc. This rotational power is transmitted between the two rotors by a coupling formed by joining together flanges formed at the end of each rotor. The coupling flanges are held together by bolts that extend through holes in the flanges. Nuts are threaded onto each of the ends of the bolts so that the nuts are circumferentially arrayed around the faces of the flanges. Unfortunately, due to the high rotational speed of the rotor, the wind resistance of the array of exposed nuts creates a power loss that degrades the efficiency of the turbomachine.

Traditionally, a close fitting coupling guard has been employed to enclose the coupling and reduce the windage associated with the rotation of the nuts. However, there is still sufficient wind resistance between the nuts and the air within the coupling guard to create a power loss. Consequently, in the past, in a further attempt to reduce windage, a circumferential slot has been machined into the outward face of each coupling flange so that the nuts are enclosed by the slot. A cover placed over the slot isolates the nuts from the air within the coupling guard. Although this arrangement greatly reduces windage, the costs associated with the machining of the rotor flanges do not make this approach cost effective.

It is therefore desirable to provide an apparatus that can be attached to the rotor coupling of a turbomachine to significantly reduce the windage losses.

SUMMARY OF THE INVENTION

Accordingly, it is the general object of the current invention to provide an apparatus for reducing the wind resistance associated with projections, such as coupling fasteners, that extend from the rotor of a turbomachine.

Briefly, this object, as well as other objects of the current invention, is accomplished in a turbomachine comprising: (i) a rotor having a flange formed thereon for coupling the rotor to another rotor, a plurality of holes being formed in the flange, (ii) a bolt extending through each of the flange holes, each of the bolts having means for attaching the bolt to the flange, and (iii) a ring attached to the flange for reducing the windage associated with the motion of the attaching means as the rotor rotates, the ring at least partially enclosing each of the attaching means.

According to one embodiment of the invention, (i) the ring has a hole for each of the attaching means that at least partially encloses the attaching means, each of the holes in the ring has a depth and each of the attaching means has a height, the hole depth being approximately equal to the attaching means height, (ii) each of the bolts has an end face that extends a distance beyond the flange, (iii) the ring has first and second faces defining a thickness therebetween, the first ring face is disposed against the flange and the thickness is approximately equal to the distance by which the bolt end face extends beyond the flange, and (iv) each of the attaching means has an outward face, whereby the bolt end faces, the ring second face, and the attaching means faces form a substantially smooth surface.

BRIEF DESCRIPTION OF THE DRAWINGS

FIG. 3 is a cross-section of the portion of the rotor flange shown in FIG. 1 enclosed by the circle III.

FIG. 4 is an exploded isometric view of the rotor coupling incorporating the anti-windage ring of the current invention (for simplicity, only one half of the anti-windage ring and only one of the coupling flanges is shown).

DESCRIPTION OF THE PREFERRED EMBODIMENT

Figure 1:
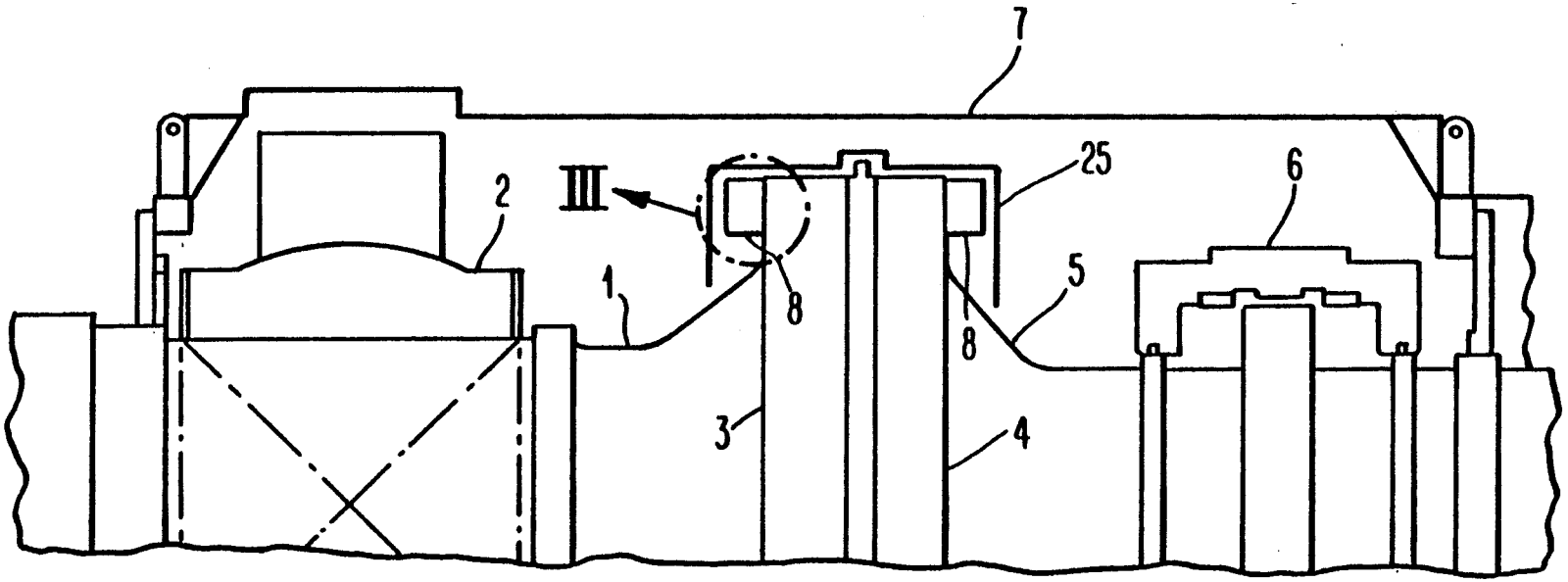
FIG. 1 is an elevation of a portion of a turbomachine in the vicinity of the rotor coupling.

Referring to the drawings, there is shown in FIG. 1 a portion of a rotor 1 of a turbomachine, such as a steam turbine or the like. A flange 3 is formed at the distal end of the rotor 1 and mates with a corresponding flange 4 of a second rotor 5. The second rotor 5 may be part of an electric generator driven by the rotor 1 or, if the turbomachine is a steam turbine, may be the rotor of another steam turbine or a jack shaft that is attached to the rotor of another steam turbine. The mated flanges 3 and 4 form a coupling through which the power of the first rotor 1 is transmitted to the second rotor 5. A journal bearing 2 supports rotor 1 and a thrust bearing 6 is applied to rotor 5.

As shown in FIG. 3, the flanges 3 and 4 are coupled by bolts 9 that are disposed through holes 17 in the flanges. As used herein, the term "bolts" refers to any threaded fastener's, including screws, studs and the like. One end of each bolt 9 extends a distance Y in the axial direction from the outward radial face 20 of the flange 3. The other end of each bolt 9 extends a similar amount (not shown) from the outward radial face of flange 4. Means for attaching the bolts 9 to the flanges 3 and 4 are also provided. In the preferred embodiment, the attaching means are nuts 10 threaded onto both ends of each bolt 9. Alternatively, the attaching means may be a head integrally formed on one end of each bolt 9 so that only one nut was required for each bolt. In the preferred embodiment, the nuts are cylindrical and installed by using a hydraulic device to stretch the bolt 9 a predetermined amount. The nuts 10 are threaded and hand-tightened onto the stretched bolts so that when the stretching is released the appropriate amount of preload is placed on the bolts 9. This assembly results in two circumferential arrays of axially projecting nuts, one of which is shown in FIG. 4, that are arranged around the faces of the flanges 3 and 4.

As shown in FIG. 1, a stationary coupling guard 25 encloses the flanges 3 and 4. In addition, a bearing housing 7 encloses the entire portion of this section of the rotors 1 and 5. As a result of the high rotational velocity of the rotors—approximately 1800 RPM for many steam turbines in electric power generation service—the nuts 10 encounter a considerable amount of drag or wind resistance—often referred to as "windage"—from the air within the coupling guard 4. As previously discussed, this windage dissipates the power output of the rotor 1 so that the efficiency of the turbomachine is degraded.

Figure 2:
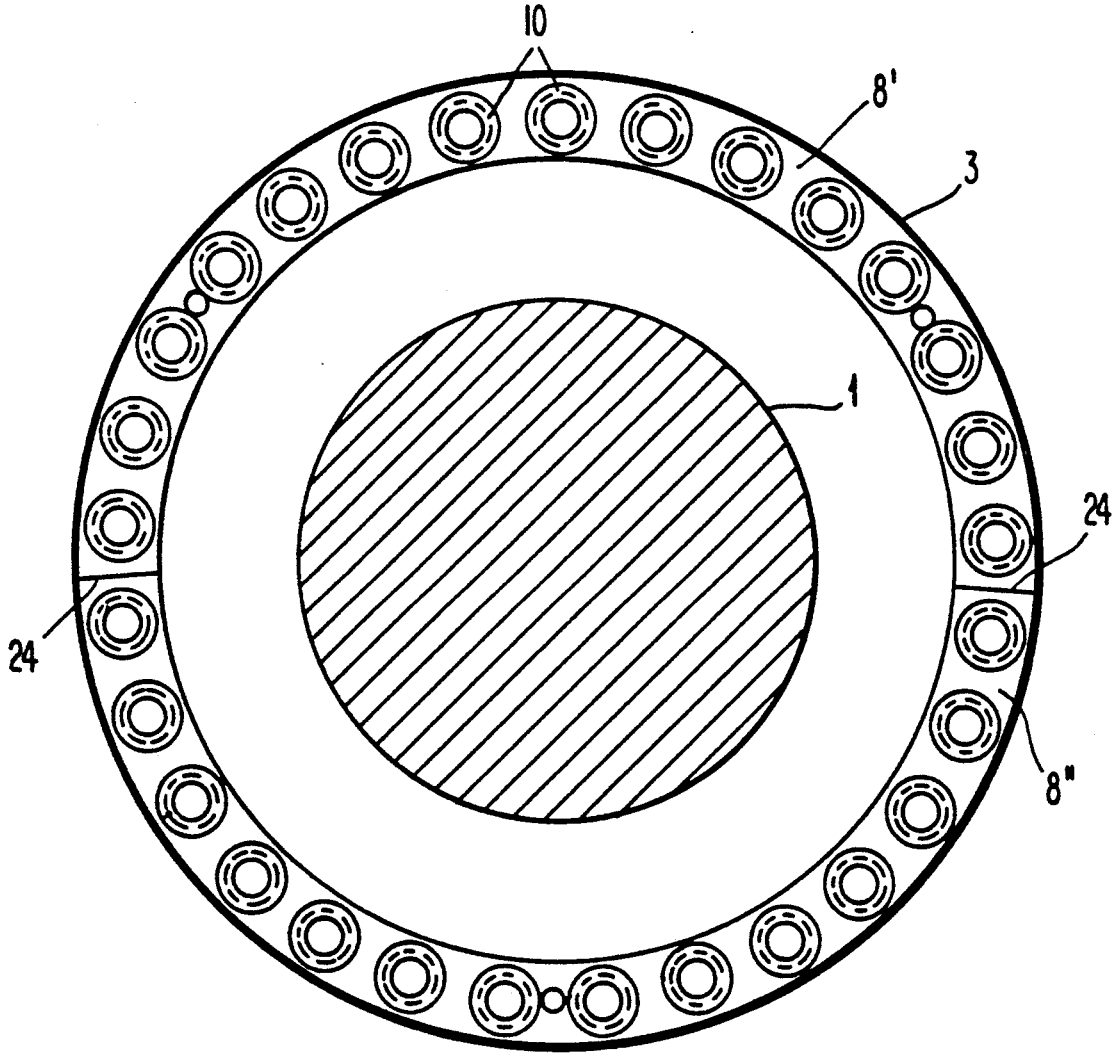
FIG. 2 is a view of the coupling shown in FIG. 1 incorporating the anti-windage device of the current invention.

According to the current invention, anti-windage rings 8 are utilized to drastically reduce the windage losses associated with the rotor coupling. As shown in FIG. 2, each anti-windage ring 8 is formed from upper and lower arcuate segments, 8' and 8'', respectively, that mate along split lines 24. The anti-windage ring 8 fills the circumferential spaces between adjacent nuts 10 and forms a smooth surfaced envelope—that is, an envelope having surfaces substantially free of steps or discontinuities that would tend to incur wind resistance—around the array of nuts. As shown in FIG. 1, an anti-windage ring is applied to the face of each of the flanges 3 and 4.

As shown in FIG. 3, the inward face 14 of the anti-windage ring 8 bears against the outward radial face 20 of the flange 3. An axially oriented hole 21 is formed in the anti-windage ring 8 for each bolt 9 and extends partially through the thickness of the anti-windage ring. A second hole 22 is formed concentrically with each hole 21 and extends the rest of the way through the anti-windage ring. As a result, a radially inward projecting annular lip 23 is formed in the hole 21 of the anti-windage ring 8. The diameter of the hole 22 is less than the outside diameter of the nut 10 so that the inward face of the nut bears against the lip 23 and securely holds the anti-windage ring 8 to the flange 3.

In the preferred embodiment, the depth X of the hole 21, shown in FIG. 3, is approximately equal to the height of the nut 10. In addition, the axial thickness Y of the anti-windage ring 8 is approximately equal to the distance by which the end face 11 of bolt 9 projects beyond the face 20 of the flange 3. Thus, when fully assembled, the end face 13 of the anti-windage ring 8, the end faces 12 of the nuts 10 and the end faces 11 of the bolts 9 are substantially flush. As a result, the anti-windage ring 8 creates a substantially smooth-surfaced envelope around the array of nuts that is bounded by the inner 16 and outer 15 circumferentially extending surfaces of the anti-windage ring 8 as well as the end faces 11, 12 and 13 of the bolts 9, nuts 10 and anti-windage ring 8, respectively.

It is important that the rotor be as symmetric as possible about its axis to minimize the amount of unbalance, since such unbalance can result in deleterious vibration of the rotor 1. Thus, it is important to accurately center the anti-windage ring 8 on the flange 3. According to the current invention, this is accomplished by machining a circular groove 18 in the face 20 of the flange 3, as shown in FIG. 3. A circular spigot 19 is formed on the inward face 14 of the anti-windage ring 8. The spigot 19 is adapted to mate with the groove 18 in a close fitting relationship, thereby ensuring that the anti-windage ring 8 is accurately located on the flange 3. The spigot 19 and groove 18 also serve to restrain the anti-windage ring halves, thereby preventing the ring halves from spreading apart under the action of centrifugal force.

Although the current invention has been described by reference to an anti-windage ring for the nuts of a coupling flange, the current invention is also applicable to circumferential arrays of other fasteners utilized in rotors, as well as circumferential arrays of other types of projections that are subject to windage. Accordingly, the present invention may be embodied in other specific forms without departing from the spirit or essential attributes thereof and reference should be made to the appended claims, rather than to the foregoing specification, as indicating the scope of the invention.

We claim:

1. A turbomachine, comprising:
   a) a rotor having a flange formed thereon for coupling said rotor to another rotor, a plurality of holes formed in said flange;
   b) a bolt extending through each of said flange holes, each of said bolts having means for attaching said bolt to said flange; and
   c) a ring, attached to said flange, having a hole for each of said attaching means, each of said ring holes at least partially enclosing each of said attaching means for reducing the windage associated with the motion of said attaching means as said rotor rotates.

2. The turbomachine according to claim 1, wherein each of said attaching means comprises a nut.

3. The turbomachine according to claim 1, wherein said ring and each of said attaching means have an end face, said end faces being substantially flush with respect to each other.

4. The turbomachine according to claim 1, wherein each of said holes in said ring has a depth and each of said attaching means has a height, said hole depth being approximately equal to said attaching means height, whereby a surface of said ring is substantially flush with a surface of each of said attaching means.

5. The turbomachine according to claim 4, wherein:
   a) each of said bolts has an end face that extends a distance beyond said flange;
   b) said ring has first and second faces defining a thickness therebetween, said first ring face being disposed against said flange, said thickness being approximately equal to said distance by which said bolt end face extends beyond said flange; and
   c) each of said attaching means has an end face;

whereby said bolt end faces, said ring second face, and said attaching means end faces form a substantially smooth surface.

6. The turbomachine according to claim 1, wherein said ring has means for being held on said flange by said attaching means.

7. The turbomachine according to claim 6, wherein said holding means comprises a projection extending radially inward from at least one of said ring holes, said projection adapted to be disposed between one of said attaching means and said flange.

8. The turbomachine according to claim 1, further comprising means for radially locating said ring with respect to said flange.

9. The turbomachine according to claim 8, wherein said flange has an outward face, and wherein said locating means comprises:
   a) a circumferential groove formed in said flange face; and
   b) a spigot formed on said ring adapted to engage said groove.

10. The turbomachine according to claim 1, wherein said ring is formed by a plurality of arcuate segments.

11. In a steam turbine having a rotor having a plurality of fasteners arranged in a circumferential array, an apparatus for reducing the wind resistance associated with the motion of said fasteners as said rotor rotates, comprising a ring filling the circumferential space between each of said adjacent fasteners.

12. The apparatus according to claim 11, further comprising means for attaching and detaching said ring from said rotor.

13. The apparatus according to claim 11, wherein:

a) said ring has a plurality of first holes for each of said fasteners extending partially therethrough and a second hole for each of said first holes, said second holes being substantially concentric with said first holes and having a smaller diameter, whereby an annular lip is formed between said first and second holes; and b) said attaching and detaching means comprises said annular lip being disposed between said fasteners and said rotor.

14. The apparatus according to claim 11, wherein:

a) said rotor has an outward radial face against which said ring bears;

b) each of said fasteners has a radial end face that extends a first distance beyond said rotor face in the axial direction; and c) said ring has a radial end face that extends a second predetermined distance beyond said rotor face in the axial direction, said first and second distances being approximately equal;

whereby said fastener means end faces and said ring end face form at least a first portion of a substantially smooth radial surface forming a boundary around said fastener means.

15. The apparatus according to claim 14, wherein each of said fasteners comprises a bolt and nut.

16. The apparatus according to claim 15, wherein each of said bolts has an end face, said bolt end faces forming a second portion of said substantially smooth boundary surface.

17. In a steam turbine having a rotor having a plurality of projections extending therefrom in a circumferential array, an attachable and detachable apparatus for reducing the wind resistance associated with the motion of said projections as said rotor rotates, comprising an arcuate member filling the circumferential space between each of said adjacent projections and forming radially and circumferentially extending surfaces substantially free of discontinuities, said surfaces forming an envelope enclosing each of said projections.

* * * * *